US009330541B1

(12) United States Patent
Ortiz

(10) Patent No.: US 9,330,541 B1
(45) Date of Patent: May 3, 2016

(54) KEY TRACKER AND METHOD FOR TRACKING SYSTEMS

(71) Applicant: Miguel A Ortiz, Philadelphia, PA (US)

(72) Inventor: Miguel A Ortiz, Philadelphia, PA (US)

( * ) Notice: Subject to any disclaimer, the term of this patent is extended or adjusted under 35 U.S.C. 154(b) by 1 day.

(21) Appl. No.: 14/588,847

(22) Filed: Jan. 2, 2015

Related U.S. Application Data

(60) Provisional application No. 61/954,520, filed on Mar. 17, 2014.

(51) Int. Cl.
*G08B 3/10* (2006.01)

(52) U.S. Cl.
CPC ..... *G08B 3/1083* (2013.01)

(58) Field of Classification Search
CPC ..... H04W 4/02; H04W 4/008; H04W 4/023; H04W 4/22; H04W 64/00; H04W 4/24; H04W 12/12; H04W 4/001
USPC ..... 340/8.1
See application file for complete search history.

(56) References Cited

U.S. PATENT DOCUMENTS

| | | | | |
|---|---|---|---|---|
| 7,477,758 | B2 * | 1/2009 | Piirainen | B60J 10/00 382/100 |
| 8,326,315 | B2 | 12/2012 | Phillips | |
| 2012/0242481 | A1 | 9/2012 | Gernandt | |
| 2012/0267430 | A1 | 10/2012 | Penny | |

* cited by examiner

*Primary Examiner* — Mark Blouin
(74) *Attorney, Agent, or Firm* — RG Patent Consulting, LLC; Rachel Gilboy

(57) ABSTRACT

An apparatus for locating misplaced keys and other objects designed with a signal transceiver and equipped with a GPS tracking chip. During use, when the user has lost an object, such as a set of keys, or any other object to which the tracking device is attached, the user may transmit signal to the tracking device on a smartphone or tablet belonging to the user via a downloadable mobile application synced for use with the tracking device in order to easily guide the user to the lost object.

20 Claims, 6 Drawing Sheets

KEY TRACKER AND METHOD FOR TRACKING SYSTEMS

CROSS-REFERENCE TO RELATED APPLICATION

The present application is related to and claims priority from prior provisional application Ser. No. 61/954,520, filed Mar. 17, 2014 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of lost object locators and more specifically relates to a key tracker and method for tracking system.

2. Description of the Related Art

Purses and wallets, remote controls, eyeglasses, and especially keys and cellular telephones are lost every day. An extended search for missing items may be necessary, to relocate the missing item(s). Whether they have slipped between chair cushions or been absently placed in another room, locating these objects can be daunting and frustrating. As many consumers may attest, furiously searching for the car keys can be extremely aggravating and time consuming, especially when running late for work or school. It is advantageous for many reasons to have an efficient and effective locating system for such items.

Various attempts have been made to solve problems found in lost object location device art. Among these are found in: U.S. Publication No. 2012/0267430 to Todd Penny; U.S. Publication No. 2012/0242481 to Tassilo Gernandt; and U.S. Pat. No. 8,326,315 to Alan Phillips. This prior art is representative of lost object locators. None of the above inventions and patents, taken either singly or in combination, is seen to describe the invention as claimed.

Ideally, a key tracker should provide a quick and convenient system and method for the expeditious recovery of a lost or misplaced key or other object, and, yet would operate reliably and be manufactured at a modest expense. Thus, a need exists for a reliable key tracker system to avoid the above-mentioned problems.

BRIEF SUMMARY OF THE INVENTION

In view of the foregoing disadvantages inherent in the known misplaced object locator art, the present invention provides a novel lost object locator having a means for tracking using a user-owned mobile communication device and also for automatically sending an email to an email address of the user when a device is stolen or misplaced. The general purpose of the present invention, which will be described subsequently in greater detail, is to provide a signal transceiver and equipped with a GPS tracking chip. During use, when the user has lost an object, such as a set of keys, or any other object to which the tracking device is attached, the user may transmit signal to the tracking device on a smartphone or tablet belonging to the user via a downloadable mobile application synced for use with the tracking device in order to easily guide the user to the lost object.

A key tracking system for use with a mobile communication device in a preferred embodiment is disclosed herein comprising a key fob assembly, a housing attacher, and a key-fob tracking application. The key-fob assembly may comprise a removably-attachable housing having an oblong profile, a microprocessor, a signal transmitter, a signal transceiver, a tracking chip (preferably comprising a GPS tracking chip), a speaker, and a remote power supplier. The removably-attachable housing may further integrally comprise a hanging clip for attaching the removably-attachable housing to a key ring. The key-fob assembly and the key-fob tracking application may comprise in functional combination the key tracking system for use with the mobile communication device.

The microprocessor, the signal transmitter, the signal transceiver, the tracking chip, the speaker, and the power supplier may be fixedly encased within the removably-attachable housing. The microprocessor may be in wired communication with the signal transmitter, the signal transceiver, the tracking chip, and the speaker.

For identification purposes, the tracking chip may comprise a unique identifier. In one embodiment, the unique identifier may comprise a distinguishable frequency that may be detectable via the mobile communication device. The power supplier may provide operating power to the key-fob assembly. The removably-attachable housing may be attachable and detachable to at least one object to be tracked via the housing attacher.

The key-fob tracking application may comprise a mobile application software that may be installable onto the mobile communication device. The key-fob tracking application may be designed and arranged to track the unique identifier of the tracking chip via the mobile communication device.

A user may be able to selectively actuate the key-fob tracking application on the mobile communication device to transmit a locator-signal to the signal transceiver of the key-fob assembly to receive a precise location of the object to be tracked on the map application of the mobile communication device and to trigger the microprocessor to emit an audible alarm from the speaker of the removably-attachable housing for ease of discovery of the object to be tracked. In the preferred embodiment, the key-fob tracking application on the mobile communication device may comprise an activation key for designating a specific key-fob assembly for locating a particular object to be tracked. It should be noted and appreciated that the audible alarm may become louder as the user moves into closer proximity to the object to be tracked, and the audible alarm may become softer as the user moves away from the object to be tracked. Other indication means may be used.

The key tracking system for use with a mobile communication device may comprise a kit. The kit may comprise the key-fob assembly, the housing attacher, the key-fob tracking application installable on the mobile communication device, and a set of user instructions.

A method of using a key tracking system for use with mobile communication device may comprise the steps of:

step one, attaching a removably-attachable housing to object to be tracked, step two, installing a key-fob tracking application onto the mobile communication device, step three, syncing a unique identifier of key-fob assembly with the key-fob tracking application loaded onto the mobile communication device, step four, activating an activation icon on the mobile communication device, and step five, tracking the object to be tracked via the map application of the mobile communication device.

The present invention holds significant improvements and serves as a key tracking system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, key tracking systems, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a key tracker and method of tracking system and more particularly to a signal transceiver and equipped with a GPS tracking chip. During use, when the user has lost an object, such as a set of keys, or any other object to which the tracking device is attached, the user may transmit signal to the tracking device on a smartphone or tablet belonging to the user via a downloadable mobile application synced for use with the tracking device in order to easily guide the user to the lost object.

Generally speaking, a key tracker and method of tracking system may comprise a specially designed wireless electronic tracking system that may equip smartphones, tablet computers, and other mobile communication devices via a downloadable application, to monitor, track, and locate a misplaced object, such as a set of keys, by detecting the location of a GPS chip embedded in the Key Tracker key-fob or key-chain.

A mobile application may be designed to enable a user to program one or more of the individual GPS key-fob chips into a mobile device of a user, so that, for example, the user might have one "contact" (or activation icon) for "keys," another for "wallet" or "purse," and another for something else (ie. a camera, a household remote-control, etc.). The mobile application may enable the user to track not just one set of keys or one item, but several items, each equipped with its own unique Key Tracker GPS key-fob. Then, when a key-fob (and its associated object) is lost or misplaced, the mobile application may enable the user to conveniently call or page that specific keyfob, activating the GPS tracking function. The mobile communication device's GPS and map application may then guide the user to the misplaced object, not only providing precise GPS coordinates as to the object's location, but emitting a series of audible beeping tones in more loudly and in more rapid succession as the user approaches the "lost" item for expeditious recovery.

The key tracker and method of tracking system may effectively turn a smartphone, tablet, or other mobile communication device into a sophisticated GPS tracking device for finding those essential items that are frequently being misplaced (such as keys, wallets, and purses). By pressing a programmed "Find Keys" icon on the mobile device, the user may quickly "call" a set of errant keys. The mobile application ("Key Tracker") may then locate the GPS chip and the set of errant keys, and guide the user via the mobile communication device utilized by the user.

Figure 1:
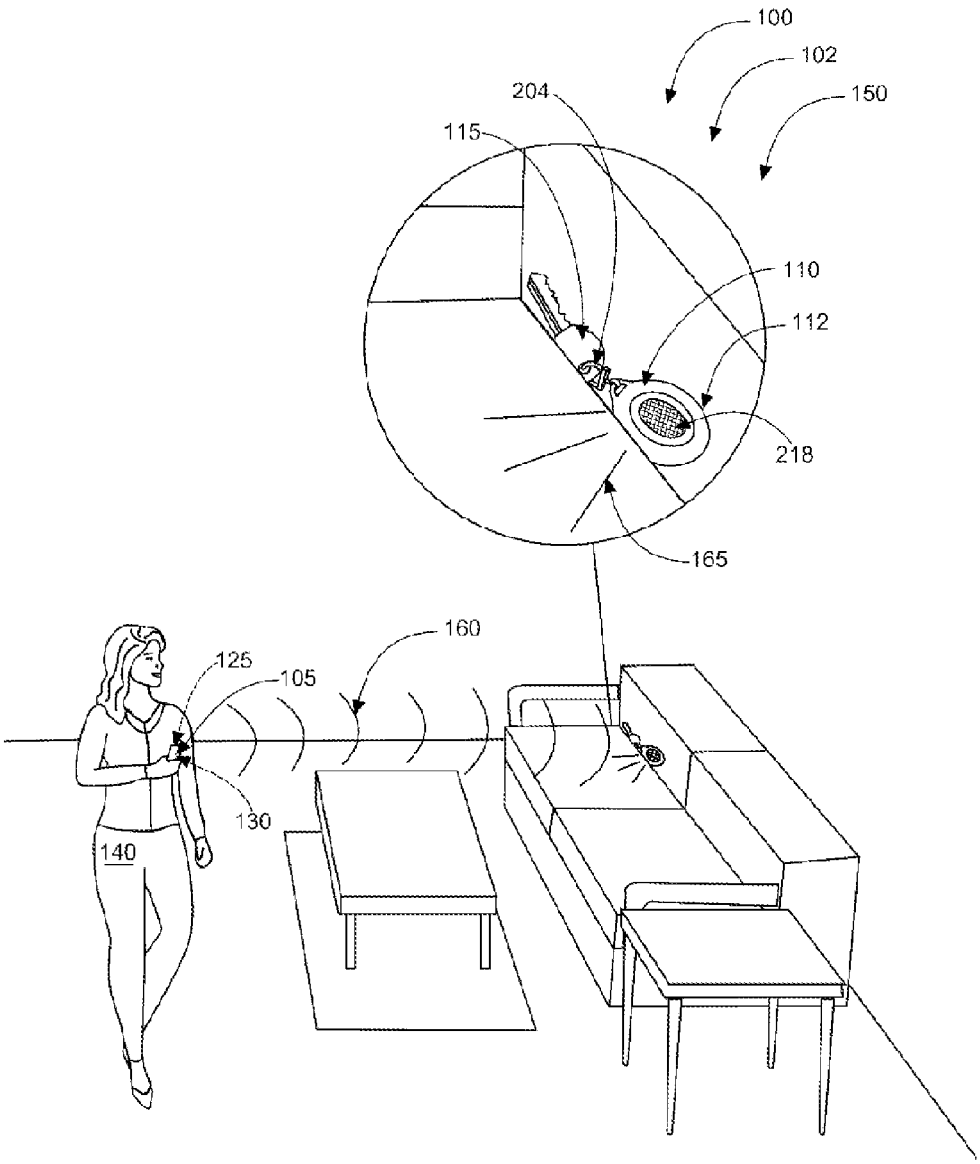
FIG. 1 shows a perspective view illustrating a key tracking system comprising at least one key-fob assembly during an 'in-use' condition showing a user tracking a misplaced set of keys according to an embodiment of the present invention.

Referring to the drawings by numerals of reference there is shown in FIG. 1, a perspective view illustrating key tracking system 100 comprising key-fob assembly 102 during 'in-use' condition 150 showing user 140 tracking a misplaced set of keys according to an embodiment of the present invention. Key tracking system 100 for use with user-selected mobile communication device 105 may comprise key-fob assembly 102 and key-fob tracking application 125. Key tracking system 100 for use with mobile communication device 105 may further comprise housing attacher 505 for removably-attachable housing 110 to object to be tracked 115. Key-fob assembly 102 and key-fob tracking application 125 may comprise in functional combination key tracking system 100 for use with mobile communication device 105.

In continuing to refer to FIG. 1, key-fob assembly 102 may comprise removably-attachable housing 110 having oblong profile 112, microprocessor 210, signal transmitter 212, signal transceiver 214, tracking chip 216, speaker 218, and power supplier 220. Power supplier 220 may be integrally installed within removably-attachable housing 110 and may provide operating power to key-fob assembly 102. Removably-attachable housing 110 may be removably attachable, as designated by user 140, to object to be tracked 115 via an object-attacher. Further, removably-attachable housing 110 may integrally comprise hanging clip 204 for attaching removably-attachable housing 110 to key-fob assembly 102.

In still referring to FIG. 1, key-fob tracking application 125 may comprise mobile application software that may be installable onto mobile communication device 105. Key-fob tracking application 125 may be designed and arranged to track unique identifier 230 of tracking chip 216 via mobile communication device 105, and user 140 may be able to selectively activate key-fob tracking application 125 on mobile communication device 105 to transmit locator-signal 160 to signal transceiver 214 of key-fob assembly 102 to receive precise location of object to be tracked 115 on mobile communication device 105 and to trigger microprocessor 210 to emit audible alarm 165 from speaker 218 for ease of discovery of object to be tracked 115.

It should be noted and appreciated that audible alarm 165 emitted from speaker 218 may be activated by microprocessor 210 and may become louder as user 140 moves into closer proximity to object to be tracked 115 such that user 140 may be able to determine a pin-point location of object to be tracked 115 via audible alarm 165. In a like manner, audible alarm 165 may become softer as user 140 moves away from object to be tracked 115 to indicate to user 140 that he or she is moving in a wrong direction.

Figure 2:
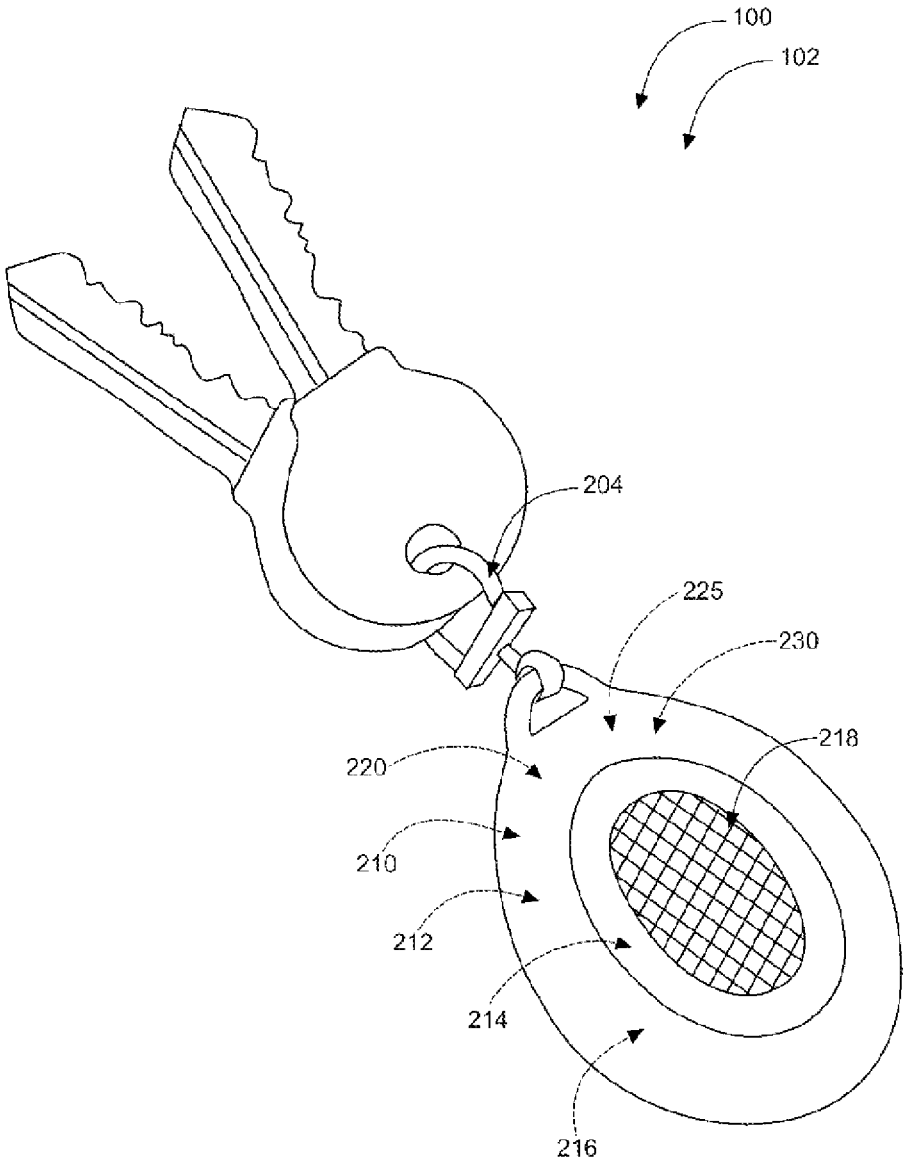
FIG. 2 is a perspective view showing the key-fob assembly comprising a removably-attachable housing having an oblong profile and comprising a speaker according to an embodiment of the present invention of FIG. 1.

Referring now to FIG. 2 showing a perspective view illustrating a perspective view showing key-fob assembly 102 comprising removably-attachable housing 110 having oblong profile 112 and comprising speaker 218 according to an embodiment of the present invention of FIG. 1. As shown, microprocessor 210, signal transmitter 212, signal transceiver 214, tracking chip 216, speaker 218, and power supplier 220 may be fixedly encased within removably-attachable housing 110.

Microprocessor 210 may be in wired communication with signal transmitter 212, signal transceiver 214, tracking chip 216, and speaker 218. The wired communication between microprocessor 210 and signal transmitter 212 may allow microprocessor 210 to transmit a signal to speaker 218 to audibly alert user 140 of the location of object to be tracked 115.

Tracking chip 216 may be in wired communication with microprocessor 210 and may comprise unique identifier 230. Unique identifier 230 on tracking chip 216 may allow user 140 to use key-fob tracking application 125 to search for a specific object to be tracked 115. Unique identifier 230 may comprise distinguishable frequency. Tracking chip 216 may further comprise GPS tracking chip 225.

The wired communication between microprocessor 210 and signal transceiver 214 may be structured and arranged such that signal transceiver 214 may receive locator-signal 160 from key-fob assembly 102 by means of user 140 activating activation icon 460 for a particular unique identifier 230 which may correspond with a particular object to be tracked 115. Locator-signal 160 may be sent from key-fob assembly 102 and received by signal transceiver 214 and may send a wired communication to microprocessor 210 to command microprocessor 210 to sound audible alarm 165 via speaker 218.

In continuing to refer to FIG. 2, removably-attachable housing 110 of key-fob assembly 102 may comprise hanging clip 204. As shown, hanging clip 204 may be useful for attaching removably-attachable housing 110 to a key ring. Further, it should be appreciated that removably-attachable housing 110 may be removably attached to object to be tracked 115 via housing attacher 505.

Figure 3:
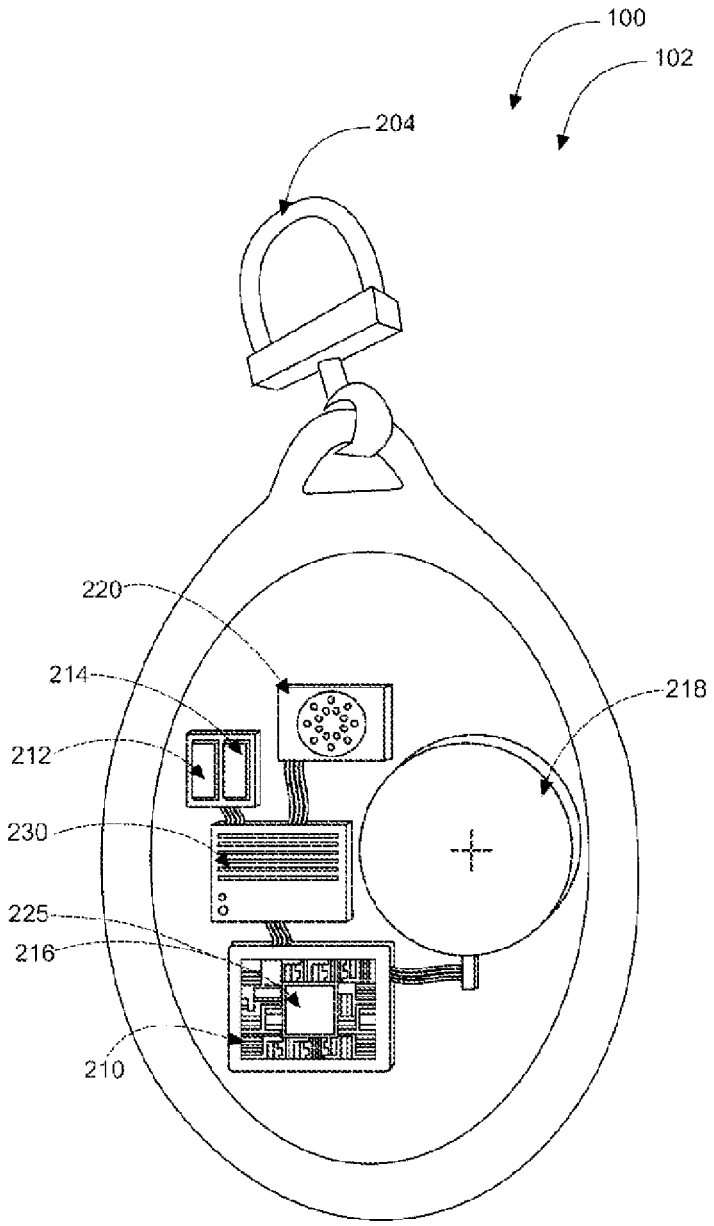
FIG. 3 is an interior perspective view illustrating integral components of the key-fob assembly fixedly installed inside the removably-attachable housing according to an embodiment of the present invention of FIG. 1.

Referring now to FIG. 3 showing an interior perspective view illustrating a plurality of integral components of key-fob assembly 102 fixedly installed inside removably-attachable housing 110 according to an embodiment of the present invention of FIG. 1. Microprocessor 210 of key-fob assembly 102 may be in wired communication with signal transmitter 212, signal transceiver 214, tracking chip 216, and speaker 218. The wired communication between microprocessor 210 and signal transmitter 212 may allow microprocessor 210 to transmit a signal through speaker 218 to audibly alert user 140 of the location of object to be tracked 115. The wired communication between microprocessor 210 and signal transceiver 214 may be structured and arranged such that signal transceiver 214 may receive a signal from key-fob assembly 102 by means of user 140 selecting activation icon 460 for a particular unique identifier 230 which may correspond with a particular object to be tracked 115. Tracking chip 216 may be in wired communication with microprocessor 210 and may comprise unique identifier 230. Unique identifier 230 may comprise a distinguishable frequency.

Figure 4A:
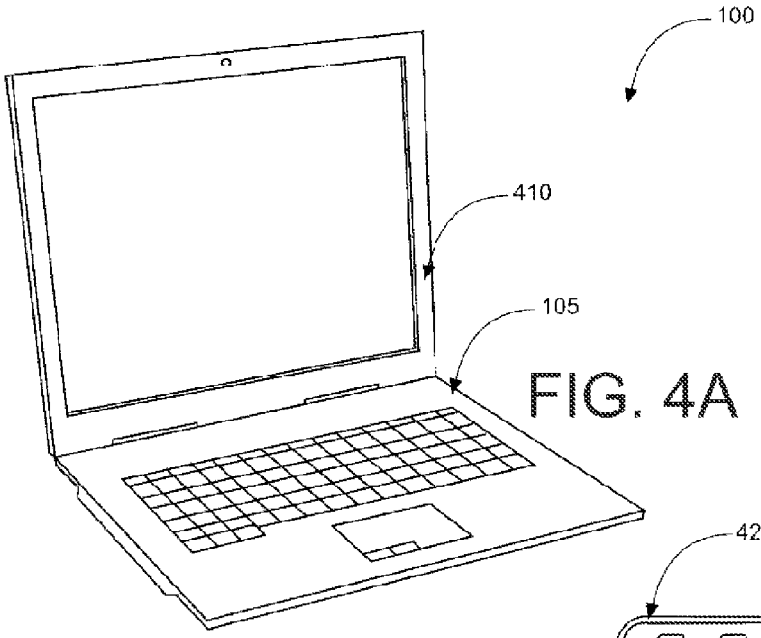
FIG. 4A is a perspective view illustrating a mobile communication device comprising a computer useful for tracking and locating at least one object to be tracked belonging to the user according to an embodiment of the present invention of FIG. 1.
Figure 4B:
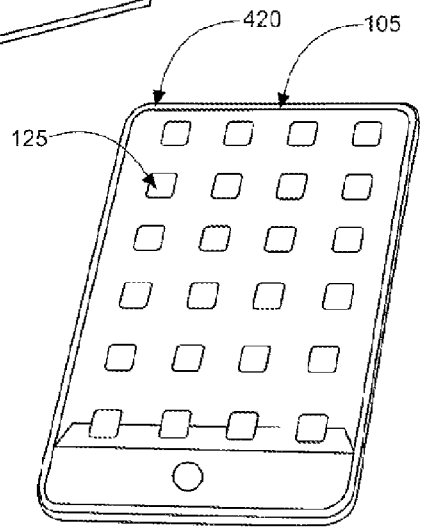
FIG. 4B is a perspective view illustrating the mobile communication device comprising a tablet useful for tracking and locating the at least one object to be tracked belonging to the user according to an embodiment of the present invention of FIG. 1.
Figure 4C:
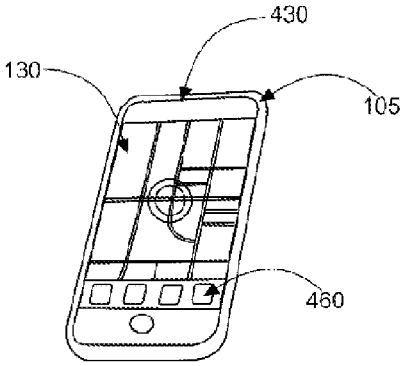
FIG. 4C is a perspective view illustrating the mobile communication device comprising a smartphone useful for tracking and locating the at least one object to be tracked belonging to the user according to an embodiment of the present invention of FIG. 1.

Referring now to FIGS. 4A-4C showing several perspective views illustrating mobile communication device(s) 105 of various kinds, each having map application 130 that may be used to track and locate object to be tracked 115 if misplaced by user 140 according to an embodiment of the present invention.

As shown in FIG. 4A, mobile communication device 105 may comprise computer 410 useful for tracking and locating object to be tracked 115 misplaced by user 140 according to an embodiment of the present invention of FIG. 1. Computer 410 may comprise either a laptop or desktop computer 410 having wireless functionality and comprising map application 130. It should be noted that key-fob tracking application 125 may be designed to be installed and loaded onto computer 410 of various types. Preferably, computer 410 may comprise map application 130 that may function in combination with key-fob tracking application 125. In such a manner, key-fob tracking application 125 may track unique identifier 230 of tracking chip 216 via map application 125 of computer 410. User 140 may be able to selectively actuate key-fob tracking application 125 on computer 410 to transmit locator-signal 160 to signal transceiver 214 of key-fob assembly 102 to receive the precise location of object to be tracked 115 on computer 410 and to trigger microprocessor 210 to emit audible alarm 165 from speaker 218 for ease of discovery of object to be tracked 115. Furthermore, computer 410 may comprise activation icon 460 for designating particular key-fob assembly 102 for locating particular object to be tracked 115.

As shown in FIG. 4B, mobile communication device 105 may comprise tablet 420 useful for tracking and locating object to be tracked 115 misplaced by user 140 according to an embodiment of the present invention of FIG. 1. Tablet 420 may comprise any tablet computer on the market having wireless functionality and with map application 130. It should be noted that key-fob tracking application 125 may be designed to be installed and loaded onto tablet 420 of various types (ie. iPad®, Playbook®, Lenovo®, Kindle®, Fire®, etc.).

Preferably, tablet 420 may comprise map application 130 that may function in combination with key-fob tracking application 125. In such a manner, key-fob tracking application 125 may track unique identifier 230 of tracking chip 216 via map application 125 of tablet 420. User 140 may be able to selectively actuate key-fob tracking application 125 on tablet 420 to transmit locator-signal 160 to signal transceiver 214 of key-fob assembly 102 to receive the precise location of object to be tracked 115 on tablet 420 and to trigger microprocessor 210 to emit audible alarm 165 from speaker 218 for ease of discovery of object to be tracked 115. Furthermore, tablet 420 may comprise activation icon 460 for designating particular key-fob assembly 102 for locating particular object to be tracked 115.

As shown in FIG. 4C, mobile communication device 105 may comprise smartphone 430 useful for tracking and locating object to be tracked 115 misplaced by user 140 according to an embodiment of the present invention of FIG. 1. Smartphone 430 may comprise any mobile phone or smartphone on the market having wireless functionality and with map application 130. It should be noted that key-fob tracking application 125 may be designed to be installed and loaded onto smartphone 430 of various types (ie. iPhone®, Android®, Galaxy®, etc.).

Preferably, smartphone 430 may comprise map application 130 that may function in combination with key-fob tracking application 125. In such a manner, key-fob tracking application 125 may track unique identifier 230 of tracking chip 216 via map application 125 of smartphone 430. User 140 may be able to selectively actuate key-fob tracking application 125 on smartphone 430 to transmit locator-signal 160 to signal transceiver 214 of key-fob assembly 102 to receive the precise location of object to be tracked 115 on smartphone 430 and to trigger microprocessor 210 to emit audible alarm 165 from speaker 218 for ease of discovery of object to be tracked 115. Furthermore, smartphone 430 may comprise activation icon 460 for designating particular key-fob assembly 102 for locating particular object to be tracked 115.

In continuing to refer to FIGS. 4A-4C, it may be noted that mobile communication device 105 may comprise activation icon 460. Activation icon 460 may comprise an icon on key-fob tracking application 125. Further, activation icon 460 may be programmed to correspond with particular key-fob assembly 102 having particular object to be tracked 115. In such a manner, user 140 may activate activation icon 460 for locating particular object to be tracked 115. For example, user 140 may have a first key-fob assembly 102 attached to a set of keys, a second key-fob assembly 102 attached to a wallet or purse, and a third key-fob assembly 102 attached to a remote control. Each particular key-fob assembly 102 comprising unique identifier 230 may be synced and programmed to different activation icon(s) 460 on key-fob tracking application 125 of mobile communication device 105. In such a manner, user 140 may activate activation icon 460 synced with the set of keys for locating and discovering the set of keys if misplaced. Or, user 140 may activate activation icon 460 synced with the wallet or purse for discovery thereof if misplaced. It should be noted that activation icon 460 is reprogrammable via key-fob tracking application 125.

Figure 5A:
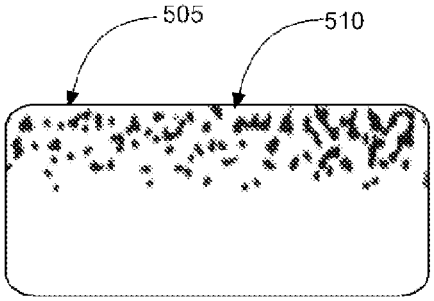
FIG. 5A is a perspective view illustrating a housing attacher comprising an adhesive useful for adhesively fixing the removably-attachable housing to the at least one object to be tracked according to an embodiment of the present invention of FIG. 1.
Figure 5B:
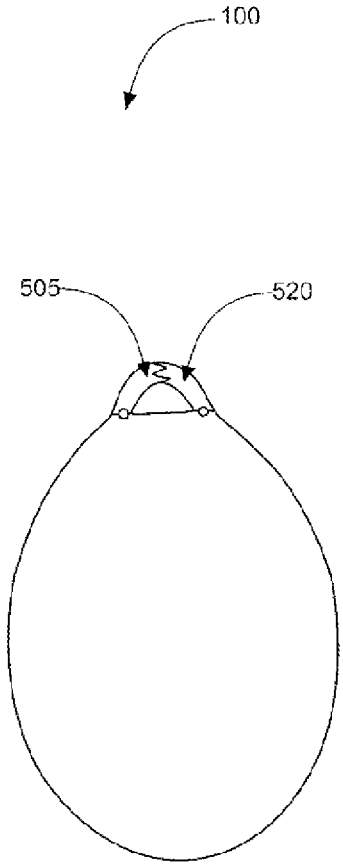
FIG. 5B is a perspective view illustrating the housing attacher comprising a fastening useful for fastening the removably-attachable housing to the at least one object to be tracked according to an embodiment of the present invention of FIG. 1.
Figure 5C:
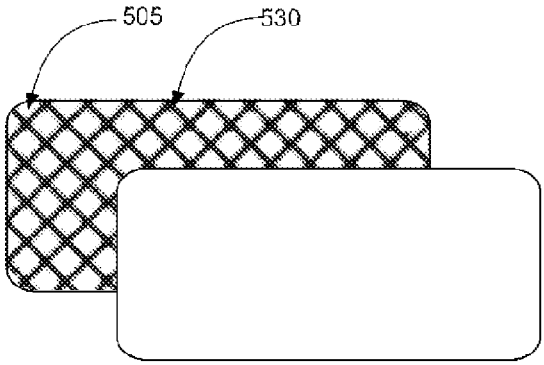
FIG. 5C is a perspective view illustrating the housing attacher comprising a magnetic coupling useful for magnetically attaching the removably-attachable housing to the at least one object to be tracked according to an embodiment of the present invention of FIG. 1.

Referring now to FIGS. 5A-5C showing several perspective views illustrating housing attacher 505 useful for attaching removably-attachable housing 110 of key-fob assembly 102 to object to be tracked 115 according to an embodiment of the present invention. As shown in FIG. 5A, housing attacher 505 may comprise adhesive 510 useful for adhesively fixing removably-attachable housing 110 to object to be tracked 115. Adhesive 510 may comprise a high-grade bonding or glue such that user 140 may peel a non-adhesive side and attach adhesive 510 to object to be tracked 115 and then attach removably-attachable housing 110 of key-fob assembly 102 to adhesive 510.

As shown in FIG. 5B, housing attacher 505 may comprise fastener 520 for fastening removably-attachable housing 110 to object to be tracked 115. In one embodiment, fastener 520 may comprise a clamp for clamping removably-attachable housing 110 to object to be tracked 115. In other embodiments, fastener 520 may comprise a clip, a securer, or other attacher for fastening removably-attachable housing 110 to object to be tracked 115.

As shown in FIG. 5C, housing attacher 505 may comprise magnetic coupling 530 useful for magnetically attaching removably-attachable housing 110 to object to be tracked 115. Magnetic coupling 530 may comprise a pair of oppositely-attracted magnets; one attached to removably-attachable housing 110 and the other attached to object to be tracked 115. The oppositely-attracted magnets may be attached via an adhesive. During use, magnetic coupling 530 may magnetically couple and uncouple for removable attachment of removably-attachable housing 110 to object to be tracked 115.

Key tracking system 100 for use with mobile communication device 105 may be sold as a kit comprising the following parts: at least one key-fob assembly 102; at least one housing attacher 505; key-fob tracking application 125; and at least one set of user instructions. The kit has instructions such that functional relationships are detailed in relation to the structure of the invention (such that the invention can be used, maintained, or the like in a preferred manner). Key tracking system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different communication means/combinations, parts may be sold separately, etc., may be sufficient.

Figure 6:
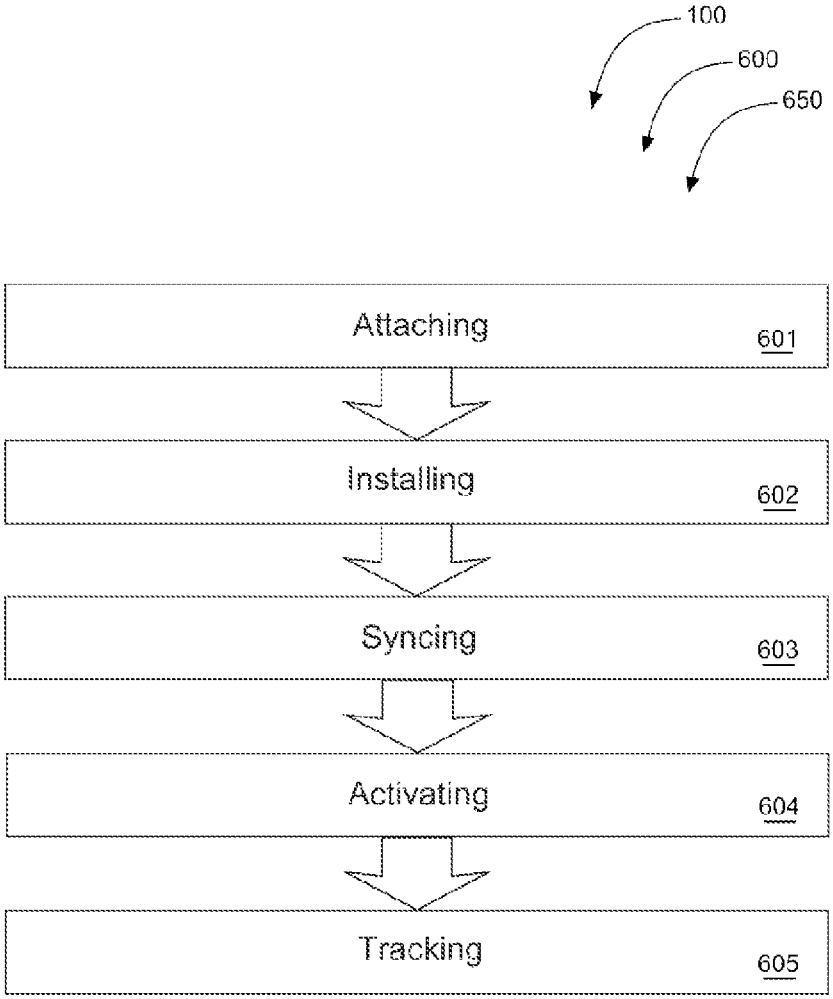
FIG. 6 is a flowchart illustrating a method of use for the key tracking system for use with a mobile communication device according to an embodiment of the present invention of FIGS. 1-5C.

Referring now to FIG. 6 showing flowchart 650 illustrating method of use 600 for key tracking system 100 for use with mobile communication device 105 according to an embodiment of the present invention of FIGS. 1-5C. As shown, method of use 600 may comprise the steps of: step one 601, attaching removably-attachable housing 110 to object to be tracked 115; step two 602, installing key-fob tracking application 125 onto mobile communication device 105; step three 603, syncing unique identifier 230 of key-fob assembly 102 with key-fob tracking application 125 loaded onto mobile communication device 105; step four 604, activating activation icon 460 on mobile communication device 105; and step five 605, tracking object to be tracked 115 via map application 130 of said mobile communication device 105.

It should be noted that the steps described in the method of use can be carried out in many different orders according to user preference. The use of "step of" should not be interpreted as "step for", in the claims herein and is not intended to invoke the provisions of 35 U.S.C. §112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A key tracking system for use with a mobile communication device comprising:

at least one key-fob assembly, said at least one key-fob assembly comprising;

a removably-attachable housing having an oblong profile;

a microprocessor;

a signal transmitter;

a signal transceiver;

a tracking chip;

a speaker; and a power supplier; and a key-fob tracking application;

wherein said at least one key-fob assembly and said key-fob tracking application comprises in functional combination said key tracking system for use with said mobile communication device;

wherein said microprocessor, said signal transmitter, said signal transceiver, said tracking chip, said speaker, and said power supplier are fixedly encased within removably-attachable housing;

wherein said microprocessor is in wired communication with said signal transmitter, said signal transceiver, said tracking chip, and said speaker;

wherein said tracking chip comprises a unique identifier;

wherein said power supplier provides operating power to said key-fob assembly;

wherein said removably-attachable housing is removably attachable to at least one object to be tracked via an object-attacher;

wherein said key-fob tracking application comprises a mobile application that is installable onto said mobile communication device;

wherein said key-fob tracking application is designed and arranged to track said unique identifier of said tracking chip via said mobile communication device; and wherein a user is able to selectively actuate said key-fob tracking application on said mobile communication device to transmit a locator-signal to said signal transceiver of said at least one key-fob assembly to receive a precise location of said at least one object to be tracked on said mobile communication device and to trigger said microprocessor to emit an audible alarm from said speaker for ease of discovery of said at least one object to be tracked.

2. The key tracking system for use with said mobile communication device of claim 1 wherein said audible alarm becomes louder as said user moves into closer proximity to said at least one object to be tracked.

3. The key tracking system for use with said mobile communication device of claim 2 wherein said audible alarm becomes softer as said user moves away from said at least one object to be tracked.

4. The key tracking system for use with said mobile communication device of claim 3 wherein said removably-attachable housing comprises a hanging clip for attaching said removably-attachable housing to a key ring.

5. The key tracking system for use with said mobile communication device of claim 4 wherein said tracking chip comprises a GPS tracking chip.

6. The key tracking system for use with said mobile communication device of claim 5 wherein said unique identifier comprises a distinguishable frequency.

7. The key tracking system for use with said mobile communication device of claim 1 further comprising a housing attacher for removably attaching said housing to said at least one object to be tracked.

8. The key tracking system for use with said mobile communication device of claim 7 wherein said housing attacher comprises an adhesive.

9. The key tracking system for use with said mobile communication device of claim 7 wherein said housing attacher comprises a fastener.

10. The key tracking system for use with said mobile communication device of claim 7 wherein said housing attacher comprises a magnetic coupling.

11. The key tracking system for use with said mobile communication device of claim 1 wherein said mobile communication device used for tracking said at least one object to be tracked comprises a computer.

12. The key tracking system for use with said mobile communication device of claim 1 wherein said mobile communication device used for tracking said at least one object to be tracked comprises a tablet.

13. The key tracking system for use with said mobile communication device of claim 1 wherein said mobile communication device used for tracking said at least one object to be tracked comprises a smartphone.

14. The key tracking system for use with said mobile communication device of claim 1 wherein said mobile communication device comprises an activation key for designating a particular said at least one key-fob assembly for locating a particular said at least one object to be tracked.

15. The key tracking system for use with said mobile communication device of claim 14 wherein said at least one object to be tracked comprises a wallet.

16. The key tracking system for use with said mobile communication device of claim 14 wherein said at least one object to be tracked comprises a smartphone.

17. The key tracking system for use with said mobile communication device of claim 14 wherein said at least one object to be tracked comprises a set of keys.

18. A key tracking system for use with a mobile communication device comprising:

at least one key-fob assembly, said at least one key-fob assembly comprising;

a removably-attachable housing having an oblong profile, said removably-attachable housing comprising a hanging clip for attaching said removably-attachable housing to a key ring;

a microprocessor;

a signal transmitter;

a signal transceiver;

a tracking chip comprising a GPS tracking chip;

a speaker; and a power supplier; and a housing attacher; and a key-fob tracking application;

wherein said at least one key-fob assembly and said key-fob tracking application comprises in functional combination said key tracking system for use with said mobile communication device;

wherein said microprocessor, said signal transmitter, said signal transceiver, said tracking chip, said speaker, and said power supplier are fixedly encased within removably-attachable housing;

wherein said microprocessor is in wired communication with said signal transmitter, said signal transceiver, said tracking chip, and said speaker;

wherein said tracking chip comprises a unique identifier, said unique identifier comprising a distinguishable frequency;

wherein said power supplier provides operating power to said key-fob assembly;

wherein said removably-attachable housing is removably attachable to at least one object to be tracked via an object-attacher;

wherein said key-fob tracking application comprises a mobile application that is installable onto said mobile communication device;

wherein said key-fob tracking application is designed and arranged to track said unique identifier of said tracking chip via said mobile communication device;

wherein a user is able to selectively actuate said key-fob tracking application on said mobile communication device to transmit a locator-signal to said signal transceiver of said at least one key-fob assembly to receive a precise location of said at least one object to be tracked on said mobile communication device and to trigger said microprocessor to emit an audible alarm from said speaker for ease of discovery of said at least one object to be tracked;

wherein said mobile communication device comprises an activation key for designating a particular said at least one key-fob assembly for locating a particular said at least one object to be tracked;

wherein said audible alarm becomes louder as said user moves into closer proximity to said at least one object to be tracked; and wherein said audible alarm becomes softer as said user moves away from said at least one object to be tracked.

19. The key tracking system for use with a mobile communication device of claim 18 further comprising a kit including:

said at least one key-fob assembly;

said housing attacher;

said key-fob tracking application installable on said mobile communication device; and a set of user instructions.

20. A method of using a key tracking system for use with at least one mobile communication device comprising the steps of:

attaching a removably-attachable housing to at least one object to be tracked;

installing a key-fob tracking application onto said at least one mobile communication device;

syncing a unique identifier of at least one key-fob assembly with said key-fob tracking application loaded onto said at least one mobile communication device;

activating an activation icon on said at least one mobile communication device; and tracking said at least one object to be tracked via a map application of said at least one mobile communication device.

* * * * *